United States Patent [19]

Hise, Jr. et al.

[11] 4,340,468

[45] Jul. 20, 1982

[54] METHOD AND APPARATUS FOR SEPARATING MATERIALS MAGNETICALLY

[75] Inventors: Eugene C. Hise, Jr., Oak Ridge; Allen S. Holman, Knoxville, both of Tenn.

[73] Assignee: The United States of America as represented by the United States Department of Energy, Washington, D.C.

[21] Appl. No.: 204,450

[22] Filed: Nov. 6, 1980 (Under 37 CFR 1.47)

[51] Int. Cl.[3] ..... B03C 1/26

[52] U.S. Cl. ..... 209/214; 209/223 R; 209/224

[58] Field of Search ..... 209/214, 222, 223 R, 209/223 A, 232, 39, 40; 210/222, 223

[56] References Cited

U.S. PATENT DOCUMENTS

| | | | |
|---|---|---|---|
| 2,604,207 | 7/1952 | Scott | 209/39 X |
| 2,652,925 | 9/1953 | Vermeiren | 209/224 X |
| 3,279,602 | 10/1966 | Kottenstette et al. | 209/214 |
| 3,608,718 | 9/1971 | Aubrey et al. | 209/214 |
| 4,042,492 | 8/1977 | Decker et al. | 209/232 X |
| 4,212,651 | 7/1980 | Eissenberg et al. | 209/214 X |
| 4,239,619 | 12/1980 | Aplan et al. | 209/214 |

FOREIGN PATENT DOCUMENTS

| | | | |
|---|---|---|---|
| 46595 | 3/1963 | Poland | 209/224 |
| 655432 | 4/1979 | U.S.S.R. | 209/39 |

*Primary Examiner*—Ralph J. Hill

*Attorney, Agent, or Firm*—Edwin D. Grant; Stephen D. Hamel; Richard G. Besha

[57] ABSTRACT

Magnetic and non-magnetic materials are separated by passing stream thereof past coaxial current-carrying coils which produce a magnetic field wherein intensity varies sharply with distance radially of the axis of the coils.

2 Claims, 5 Drawing Figures

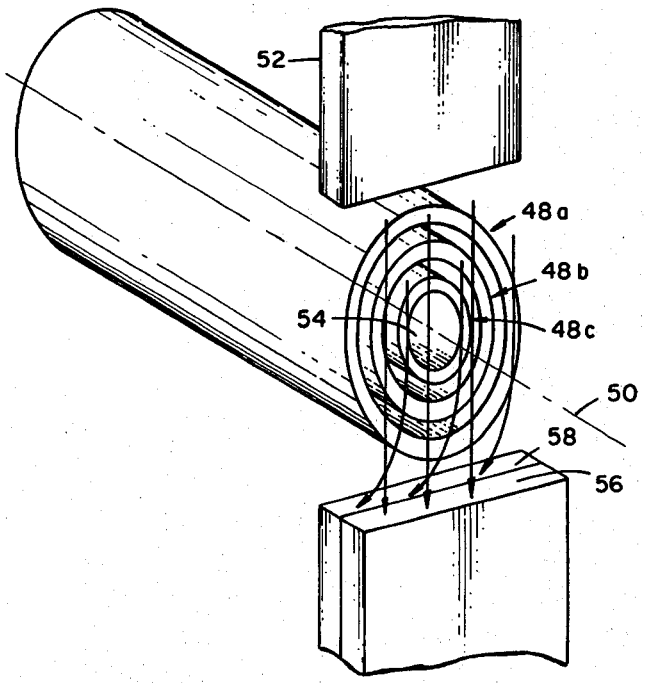

METHOD AND APPARATUS FOR SEPARATING MATERIALS MAGNETICALLY

BACKGROUND OF THE INVENTION

This invention, which was made under a contract with the United States Department of Energy, relates to an improved method and apparatus for separating materials having different magnetic properties.

Impurities such as iron pyrite have previously been separated from pulverized coal by magnetic devices. However, many of the known types of magnetic separators use magnetized collectors from which a separated constituent of a coal mixture must be periodically removed. Although efforts have also been made to use a magnetic field to deflect magnetic material traveling along a path and thereby separate it from non-magnetic material associated therewith, known devices utilizing this principle of operation have not been practical for use in large scale commercial operations because of their inabilities to generate the required magnetic field in a large volume.

PRIOR ART

In an article titled "High Gradient Magnetic Separation Theory and Application", published in September, 1976, in IEEE Transactions on Magnetics, Vol. Mag-12, No. 5, R. Oder described a magnetic separator comprising a stacked series of electromagnetic coils surrounding a matrix of steel wool, the latter being magnetized by the coils so that magnetic constituents of a particulate mixture passed through the matrix are captured thereby. Also described in the same article is a magnetic separator comprising a compartmented carrier rotatably mounted within a section of an electromagnetic coil, matrix materials being disposed in the compartments of the carrier for collecting magnetic material passed therethrough. In these separators, material captured in a matrix is periodically removed therefrom by de-energizing the coil or coils associated therewith and thereafter flushing the material from the matrix. In the same IEEE publication, other separators which use an annular magnet are described. An article by H. Cohen and J. Good in the aforesaid publication, titled "The Principles and Operation of a Very High Intensity Magnetic Mineral Separator", describes an apparatus wherein an annular magnet surrounds a tube through which a mixture of magnetic and non-magnetic material is passed. Magnetic particles are attracted to one side of the tube and travel along the wall thereof until they reach an opening and pass from the tube. Cohen and Good also describe in their article an apparatus in which a mixture of magnetic and non-magnetic material is introduced into a channel surrounding an annular magnet, the material traveling in a circular path around the magnet and the magnetic portion thereof moving toward the magnet so that it is separated from the non-magnetic portion. Separation of magnetic material from coal by use of a magnetic material collecting matrix of the above-described type is also considered in a Bureau of Mines Report prepared by F. E. Luborsky under the title "High Gradient Magnetic Separation For Removal of Sulfur From Coal", and released in February, 1977.

In an article titled "Magnetic Separation: A Review of Principles, Devices and Applications", published in June, 1974, in IEEE Transactions on Magnetics, Vol. MAG 10, No. 2, J. A. Oberteuffer describes various types of material separators in which materials is attached to a collector magnetically and subsequently released. Also described in the same article is a Frantz-Isodynamic separator in which a mixture of magnetic and non-magnetic materials is passed between the poles of a C-shaped magnet, the magnetic force of the magnetic deflecting particles from a straight fall path.

U.S. Pat. No. 4,052,170, issued to T. Yan on Oct. 4, 1977, discloses a coal beneficiation apparatus comprising a vertically disposed tube (see FIG. 4 of the patent) and a plurality of magnet pole pieces disposed around the periphery of the tube. Particulate coal containing magnetic particles passes through the tube and the magnetic particles are attracted and held at the wall thereof until they are dislodged by rotating vanes.

SUMMARY OF THE INVENTION

It is therefore an object of this invention to provide an improved method and apparatus for separating materials having different magnetic properties.

A more specific object of the invention is to provide an arrangement of electromagnetic coils capable of generating a magnetic field the intensity of which changes sharply over a small distance.

Another object of the invention is to provide an efficient apparatus for magnetically separating iron pyrite from pulverized coal on a continuous basis.

These objects are achieved in accordance with the present invention by passing a mixture of materials having different magnetic properties through a magnetic field created by electromagnetic coils arranged in a particular manner that will be described in detail hereinafter, the magnetic material in the mixture being deflected relative to a common central axis of the coils but passing by the coils without coming into contact therewith.

In all embodiments of the invention a plurality of electromagnetic coils are arranged so as to create a magnetic field the intensity of which varies greatly over a small distance.

DESCRIPTION OF PREFERRED EMBODIMENTS OF THE INVENTIONS

Figure 1:
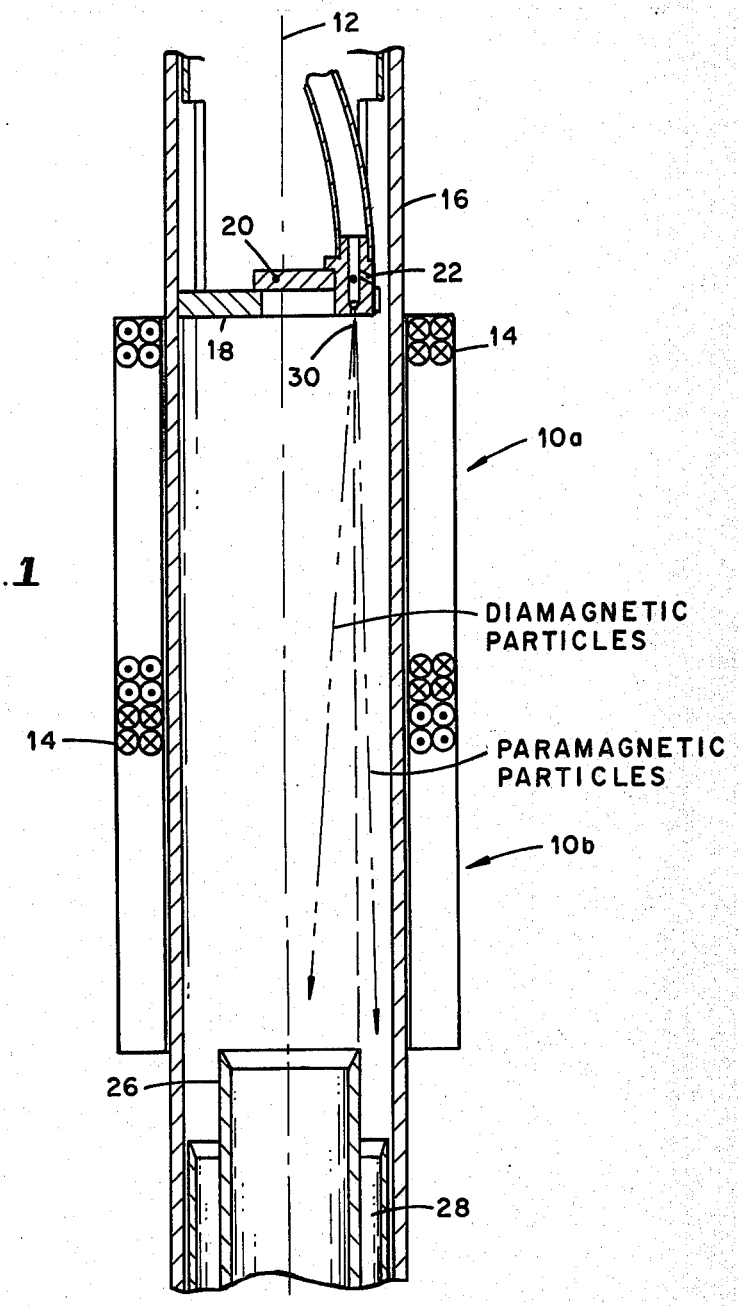
FIG. 1 is a diagrammatic, cross-sectional representation of one preferred embodiment of the invention.

In the embodiment of the invention illustrated in FIG. 1, two identically-shaped electromagnetic coils (generally designated by reference numbers 10*a*, 10*b*)

are tandemly disposed relative to a common central axis 12. Each of the coils comprises a plurality of windings 14 which extends circumferentially around axis 12, and each coil is connected to a source of electric energy which supplies current to the coils in the directions indicated in the drawing by dots and crosses associated with the windings. More particularly, curent flows through the windings of coil 10 in a counterclockwise direction as viewed from a point above and coil, and current flows through coil 10*b* in the opposite direction, points and crosses associated with the coil windings respectively representing points and tails of direction indicating arrows in FIG. 1. The axis of the coils is vertically disposed.

A tube 16 extends through coils 10*a*, 10*b* in coaxial relation therewith, and secured in the upper portion of this tube is a support plate 18 on which a slide 20 is mounted for adjustable movement radially of the tube. A nozzle 22 is attached to slide 20, and a flexible conduit 24 connects this nozzle to a conventional feed supply source. Two tubes 26, 28 are disposed in concentric, spaced relation in the lower portion of tube 16 and respectively collect diamagnetic and paramagnetic particles included in a feed stream 30 discharged from nozzle 22, as will be considered in further detail hereinafter.

Figure 2:
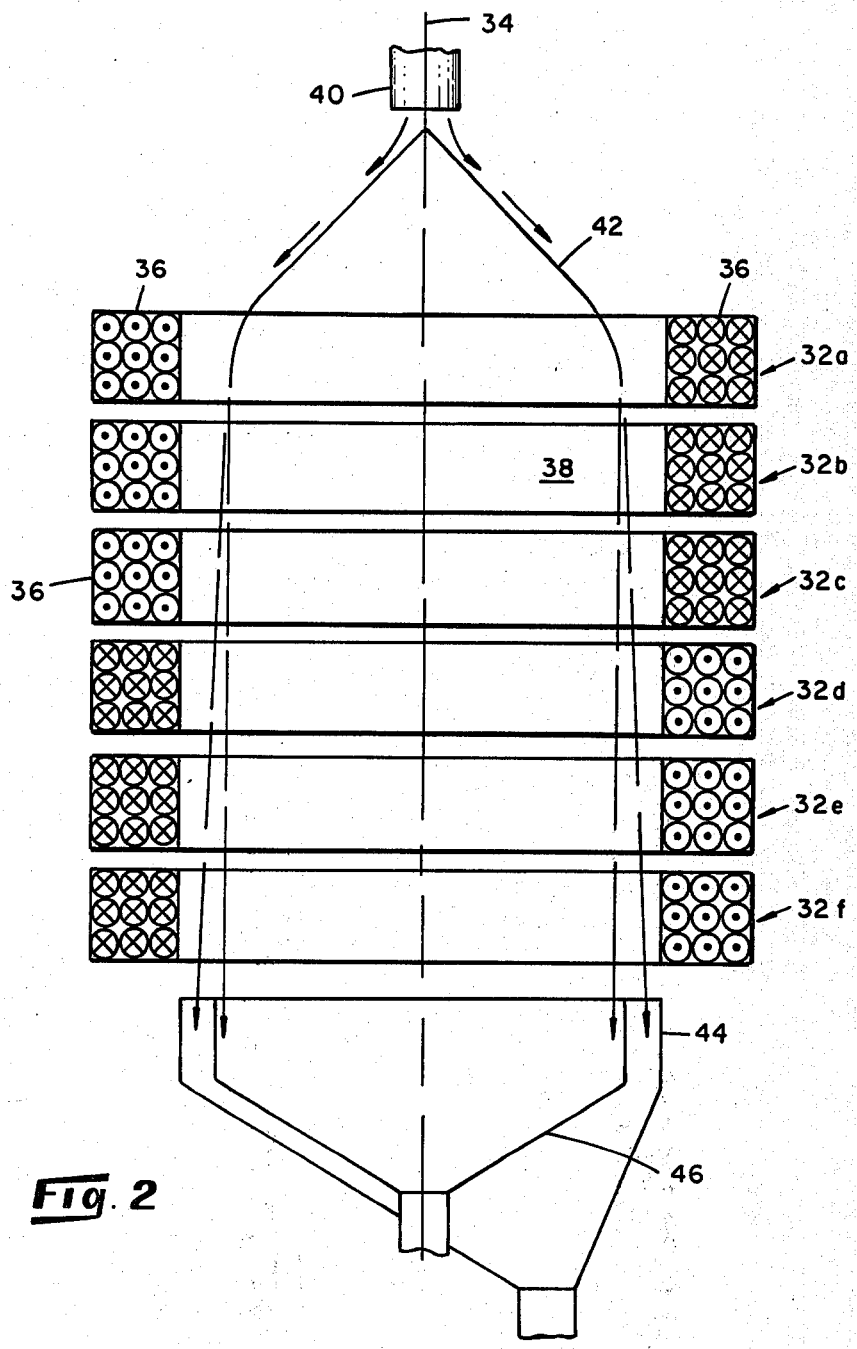
FIG. 2 is a diagrammatic, cross-sectional representation of another preferred embodiment of the invention that includes a plurality of electromagnetic coils arranged in two sets, flow of electric curent in the windings of the coils of one of the sets being opposite that in the windings of the coils of the other set.

The embodiment of the invention illustrated in FIG. 2 comprises a plurality of electromagnetic coils which are generally designated by reference number 32*a*–32*f*, the arrangement of these coils corresponding to that of coils 10*a*, 10*b* of the above-described apparatus in that they are also tandemly disposed relative to a vertical central axis 34. The windings 36 of coils 32*a*–32*f* are connected to a source of electric energy which supplies current in the directions indicated by dots and crosses associated with the windings. A stream 38 containing particles with different magnetic properties is discharged from a conduit 40 onto a cone 42 the vertical axis of which is coincident with the central axis 34 of coils 32*a*–32*f*, and collector funnels 44, 46 separate the material spectrum of this stream after the particles fall from the cone and pass through the coils. The operation of this embodiment of the invention will be further described hereinafter.

Figure 3:
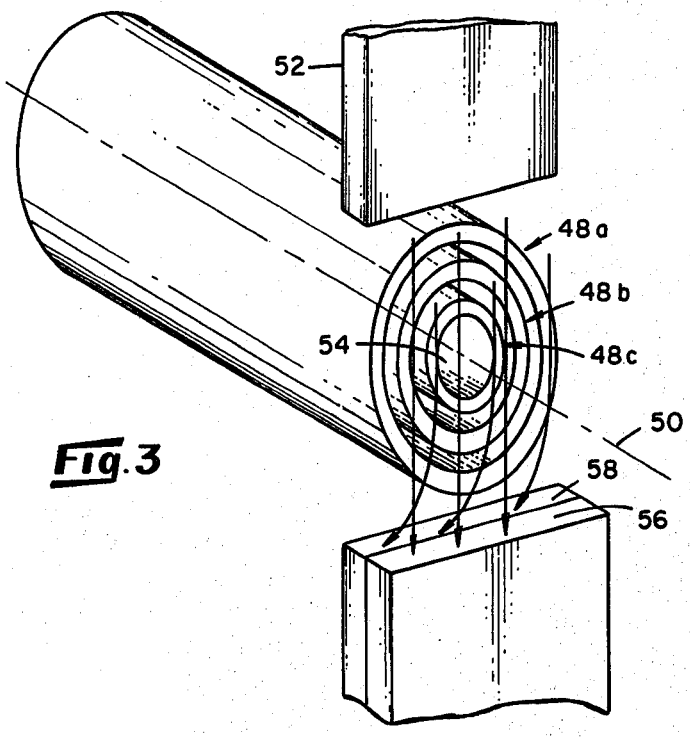
FIG. 3 is a diagrammatic representation of a third prefered embodiment of the invention, wherein flow of a material relative to the electromagnetic coils of the embodiment differs from that illustrated in FIGS. 1 and 2.

As illustrated in FIG. 3, a third embodiment of the invention includes three electromagnetic coils generally designated by reference numbers 48*a*–48*c*, these coils having a common horizontally extending central axis 50 and being arranged in spaced, concentric relation. The ends of these coils lie in a plane perpendicular to axis 50, and a duct 52 discharges a narrow stream 54 of magnetic and non-magnetic particles downwardly across the coil ends in spaced, parallel relation therewith. The windings of each of the coils 48*a*–48*c* extend circumferentially around axis 50, and they are connected to a source of electric energy so that current passes through them in the same direction. As will also be discussed hereinafter, the magnetic field generated by coils 48*a*–48*c* causes magnetic particles in stream 54 to be deflected toward or away from the coils, depending upon the type of magnetic susceptibility possessed by the particles (paramagnetic or diamagnetic), and non-magnetic particles in the stream follow a straight path. A duct 56 is positioned below the coils and is divided by a partition 58 into two channels which separate the material spectrum of stream 54 (arrows in the drawing showing deflection of paramagnetic particles toward the coils for the purpose of illustration).

DESCRIPTION OF OPERATION OF THE PREFERRED EMBODIMENTS OF THE INVENTION

The force F acting on a particle of magnetic material disposed in a magnetic field is expressed by the following equation:

$$\vec{F} = Vp(\vec{Mp} \cdot \nabla)\vec{H}$$

wherein

Vp = volume of a particle $\vec{Mp}$ = magnetization of the particle $\vec{H}$ = magnetic field intensity Accordingly, if stream 30 of FIG. 1 contains paramagnetic and diamagnetic particles (such as, for example, iron pyrite particles and coal particles) the paramagnetic and diamagnetic particles will be deflected in opposite directions by a magnetic force exerted by the coils times the magnetic susceptibility of the particle. A corresponding effect is produced by the arrangements of FIGS. 2 and 3.

The arrangement of coils 10*a*, 10*b* which is illustrated in FIG. 1 provides a large force component in a radial direction near the coils and the force decreases as the radial distance from the coils increases, either inside or outside the tube. Hence adjacent the wall of tube 16 a large magnetic force acts on a particle of magnetic material in stream 30 so that paramagnetic particles enter tube 28 whereas diamagnetic particles enter tube 26. Slide 20 can be adjusted to position nozzle 22 at different points across tube 16 to thereby control the relative amounts of material entering tubes 26 and 28. The same type of magnetic field exists outside coils 10*a*, 10*b*, and thus a nozzle 22 could be located outside the coils and a suitable collector could be provided to separate the material deflected by the magnetic field surrounding the coils. The arrangement of coils 32*a*–32*f* of the FIG. 2 embodiment of the invention in two sets (namely, a first set consisting of coils 32*a*–32*c* and a second set consisting of coils 32*d*–32*f*) and the directions in which electric current passes through the coils of the two sets (namely, clockwise in coils 32*a*–32*c* and counterclockwise in coils 32*d*–*f* if the coils are viewed from a point above the coils) also creates the same large radial force components near the coils. Thus strong magnetic forces are exerted on magnetic particles in the cylindrically shaped stream 38 and the particles are deflected into a spectrum which is separated by funnels 44 and 46.

Figure 4:
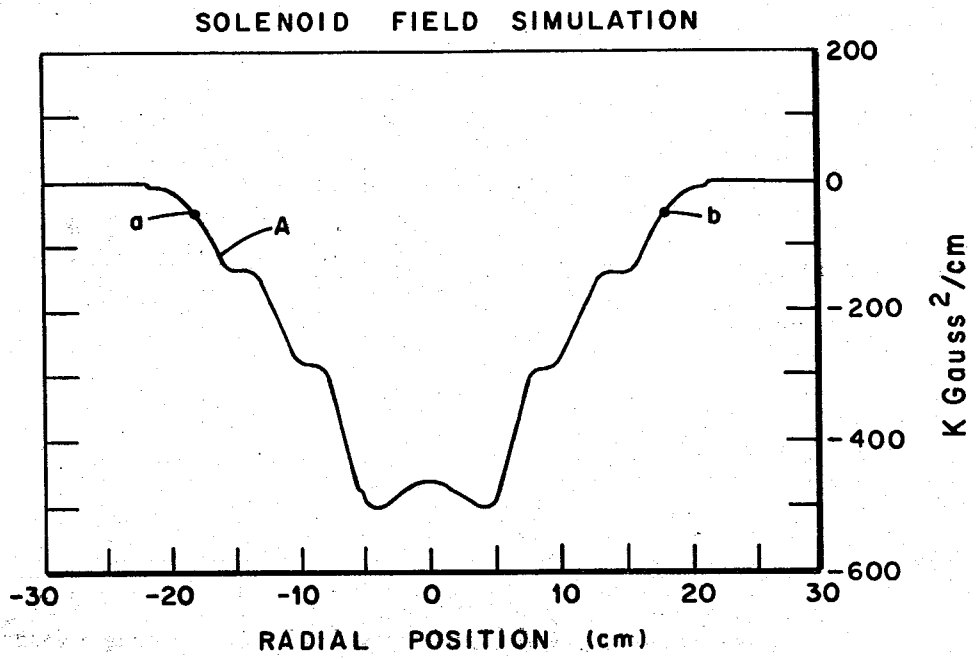
FIG. 4 is a graph illustrating the magnetic field intensity across the ends of the electromagnetic coils illustrated in FIG. 3.

In the graph shown in FIG. 4 curve A shows the magnetic force created by coils 48*a*–48*c* of FIG. 3 at different points lying in a verticle plane that includes the horizontal central axis 50 of the coils, the abscissa axis showing distance of a point from axis 50 and the ordinate axis showing kilogauss$^2$/cm at the point.

It will be seen from the graph that a large separating force exists between points a and b on curve A. Separation of coal particles has been demonstrated with forces on the order of 70 K gauss$^2$/cm, which this configuration easily meets or exceeds between point a and b.

Particles discharged from duct 52 are deflected into a spectrum as they pass by coils 48*a*–48*b* and are separated into two streams by plate 58 in duct 56.

Figure 5:
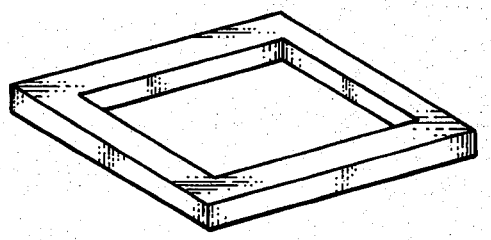
FIG. 5 illustrates a type of electromagnetic coil that can also be used in apparatus constructed in accordance with principles of the invention.

It is not necessary to use annular coils in apparatus in accordance with the invention. Coils of the shape illustrated in FIG. 5 or ellipsoidal coils can also be stacked in the manner of coils 10*a*, 10*b* of FIG. 1 or coils 32*a*–30*f* of FIG. 2 to provide magnetic fields in which field intensity varies greatly over a small distance.

What is claimed is:

1. Apparatus for separating materials having different magnetic properties, comprising:

a plurality of concentrically disposed, current-conducting coils each having a plurality of windings extending circumferentially about a central axis;

means for passing a stream of said materials across ends of said coils in a direction substantially normal to said axis; and means for separately collecting portions of said materials that travel along different paths while crossing the ends of said coils under the influence of the magnetic field produced by said coils.

2. A method for separating materials having different magnetic properties employing a plurality of concentrically disposed, current-conducting coils each having a plurality of windings extending circumferentially about a central axis, comprising; passing a stream of said materials across ends of said coils in a direction substantially normal to said axis; and separately collecting portions of said materials that travel along different paths while crossing the ends of said coils under the influence of the magnetic field produced by said coils.

* * * * *